US010569591B2

(12) United States Patent
Adair

(10) Patent No.: US 10,569,591 B2
(45) Date of Patent: Feb. 25, 2020

(54) GREETING CARD HAVING A BIASING MEMBER

(71) Applicant: HALLMARK CARDS, INCORPORATED, Kansas City, MO (US)

(72) Inventor: Michael Robert Adair, Overland Park, KS (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

(21) Appl. No.: 15/630,353

(22) Filed: Jun. 22, 2017

(65) Prior Publication Data

US 2018/0370272 A1 Dec. 27, 2018

(51) Int. Cl.
*B42D 15/04* (2006.01)

(52) U.S. Cl.
CPC ..... *B42D 15/045* (2013.01); *B42D 15/042* (2013.01)

(58) Field of Classification Search
CPC ..... B42D 15/045; B42D 15/04; B42D 15/042
USPC ..... 206/232
See application file for complete search history.

(56) References Cited

U.S. PATENT DOCUMENTS 1,448,115 A 3/1923 Graham
3,010,246 A 11/1961 England
3,035,363 A 5/1962 Luchsinger
3,481,061 A * 12/1969 Julin ..... B42D 15/042 40/124.09
3,664,049 A * 5/1972 Smith ..... B42D 15/04 206/805
6,508,023 B2 * 1/2003 Moss ..... G09F 1/06 40/610
7,370,447 B2 5/2008 Carlin et al.
2010/0170822 A1 * 7/2010 Davis ..... B42D 15/045 206/486

FOREIGN PATENT DOCUMENTS

GB 2446955 A 8/2008

OTHER PUBLICATIONS

Examination Report dated Jul. 23, 2018 in Canadian Patent Application No. 2,974,599, 4 pages.
Examiner's Report dated May 15, 2019 in Canadian Patent Application No. 2,974,599, 3 pages.

* cited by examiner

*Primary Examiner* — Anthony D Stashick
*Assistant Examiner* — Raven Collins
(74) *Attorney, Agent, or Firm* — Shook, Hardy & Bacon L.L.P.

(57) ABSTRACT

A greeting card generally comprising panels and a biasing member which stores a compressive force or a tensional force. The biasing member is coupled to the greeting card, such that the greeting card moves to an open configuration or a closed configuration, depending on the type of force held by the biasing member.

17 Claims, 12 Drawing Sheets

GREETING CARD HAVING A BIASING MEMBER

SUMMARY

This Summary is provided to introduce a selection of concepts in a simplified form that are further described below in the Detailed Description. This Summary is not intended to identify key features or essential features of the claimed subject matter, nor is it intended to be used in isolation as an aid in determining the scope of the claimed subject matter.

Embodiments of the present invention are directed to a greeting card having an open configuration and a closed configuration. The greeting card generally comprises a biasing member which stores a compressive force or a tensional force, such that the biasing member moves the greeting card to the open or closed configuration, depending on the type of force held by the biasing member.

BRIEF DESCRIPTION OF THE DRAWINGS

Embodiments of the invention are described in detail below with reference to the attached drawing figures, wherein.

DETAILED DESCRIPTION

The subject matter of embodiments of the invention disclosed herein is described with specificity to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies.

Aspects herein are generally directed to a greeting card having an open configuration and a closed configuration, the greeting card comprising a center panel having a front surface and a back surface, a left panel having a front surface and a back surface, wherein the left panel is coupled to the center panel at a left pivot point, a right panel having a front surface and a back surface, wherein the right panel is coupled to the center panel at a right pivot point, and a biasing member coupling a portion of the left panel to a portion of the right panel. When the greeting card is in the open configuration, the portion of the left panel and the portion of the right panel are positioned proximate the back surface of the center panel, and when the greeting card is in the closed configuration, the biasing member contains a tensional force greater than when the greeting card is in the open configuration, wherein the tensional force is operable to move the greeting card from the closed configuration to the open configuration.

In other aspects herein, a greeting card having an open configuration and a closed configuration is provided, the greeting card comprising first and second panels coupled together, wherein the first panel is movable with respect to the second panel about a first pivot point having a first axis. The first axis is generally within a plane of the first panel, wherein the first panel has an effort arm portion on one side of the first pivot point and a load arm portion on a side of the first pivot point opposite the effort arm portion, and a biasing member coupled with the effort arm portion of the first panel and operable to move the first panel about the first pivot point.

In yet another aspect, a method of manufacturing a greeting card is provided having an open configuration and a closed configuration, the method comprising providing a greeting card having at least a center panel, a left panel and a right panel, providing a biasing member, coupling a first portion of the biasing member to a first portion of the left panel, and coupling a second portion of the biasing member to a first portion of the right panel, and wherein when the greeting card is in the open configuration, the portion of the left panel and the portion of the right panel are positioned proximate a back surface of the center panel.

Figure 8:
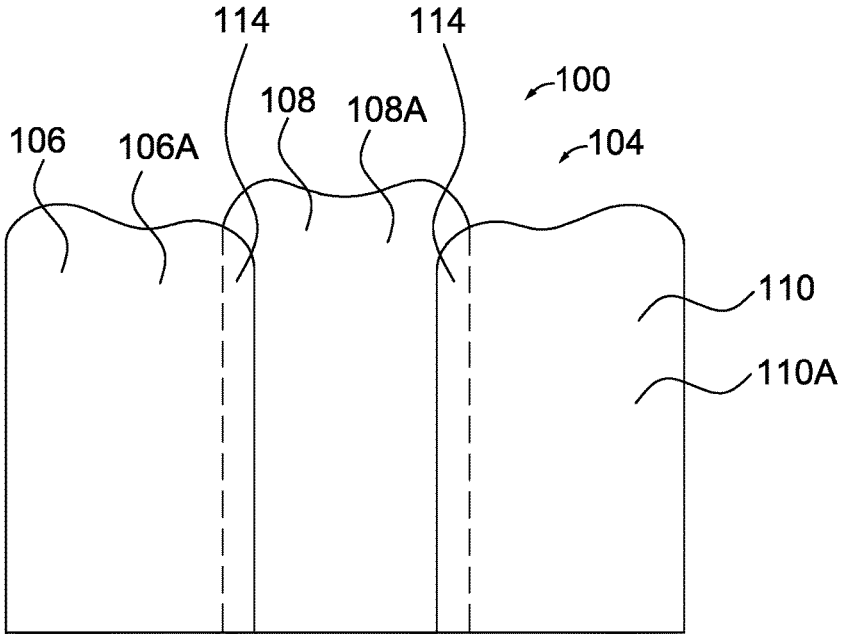
FIG. 8 illustrates a back view of the exemplary three-paneled greeting card in the open configuration, in accordance with aspects herein.
Figure 9:
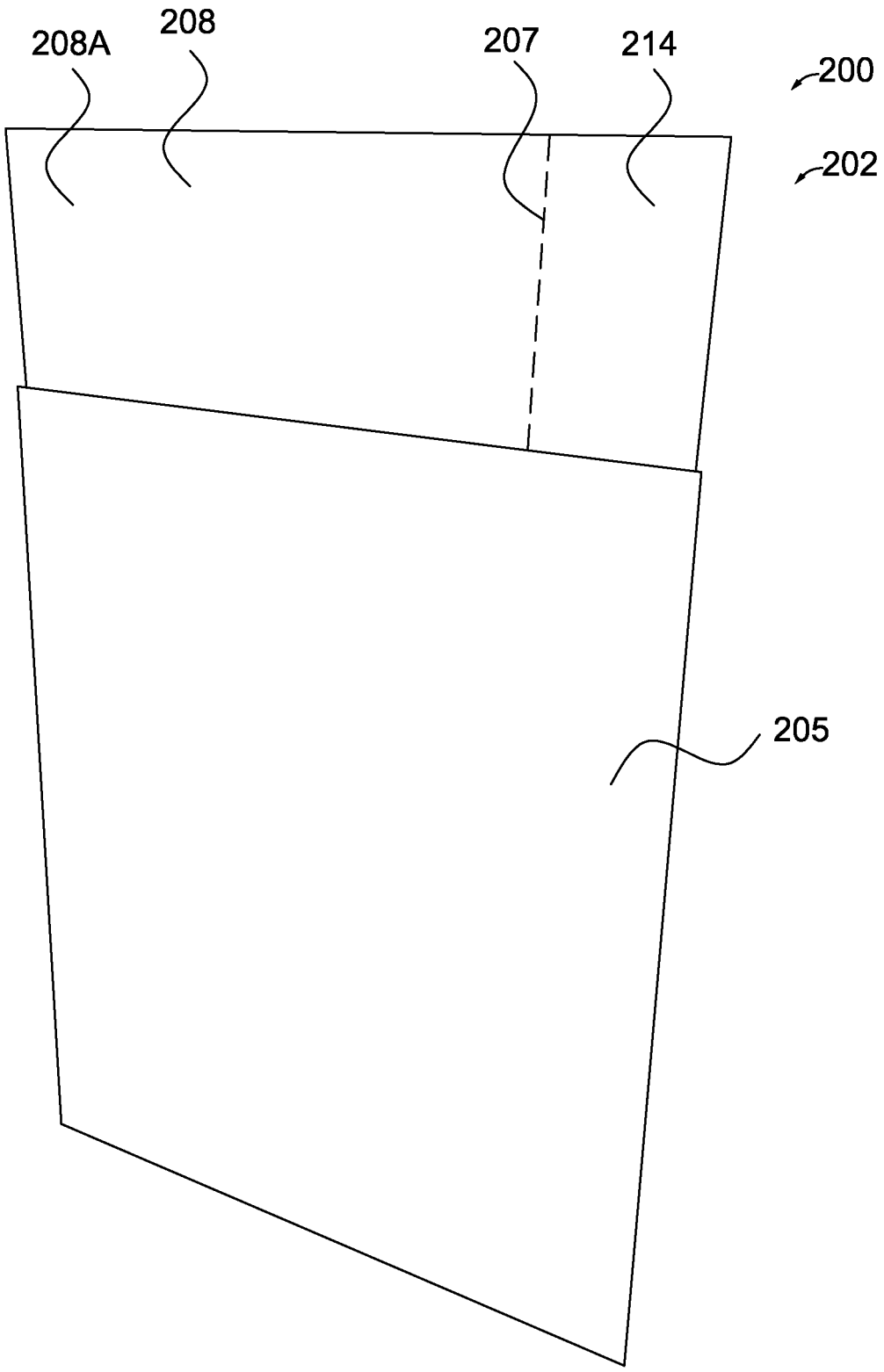
FIG. 9 illustrates a perspective view of an exemplary two-paneled greeting card in the closed configuration, in accordance with aspects herein.
Figure 10:
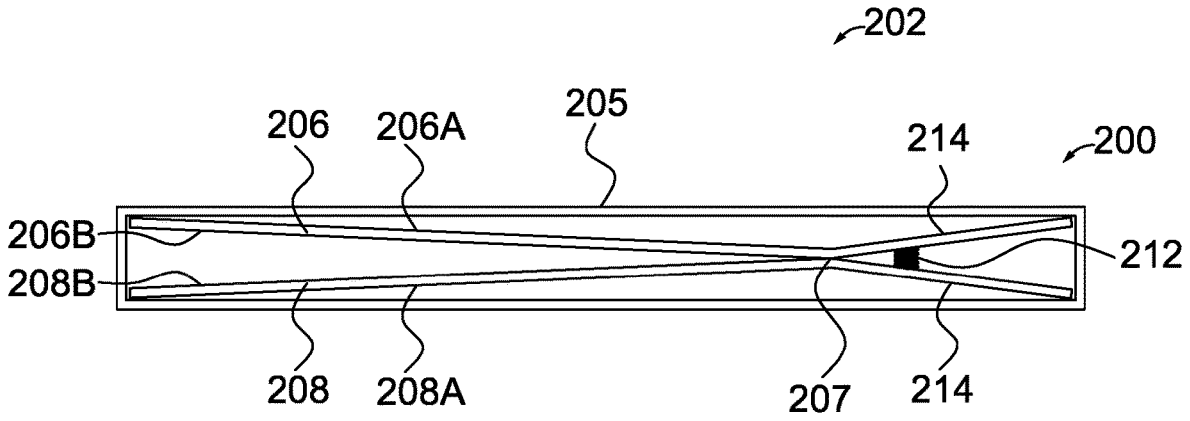
FIG. 10 illustrates a top view of the exemplary two-paneled greeting card in the closed configuration, in accordance with aspects herein.
Figure 11:
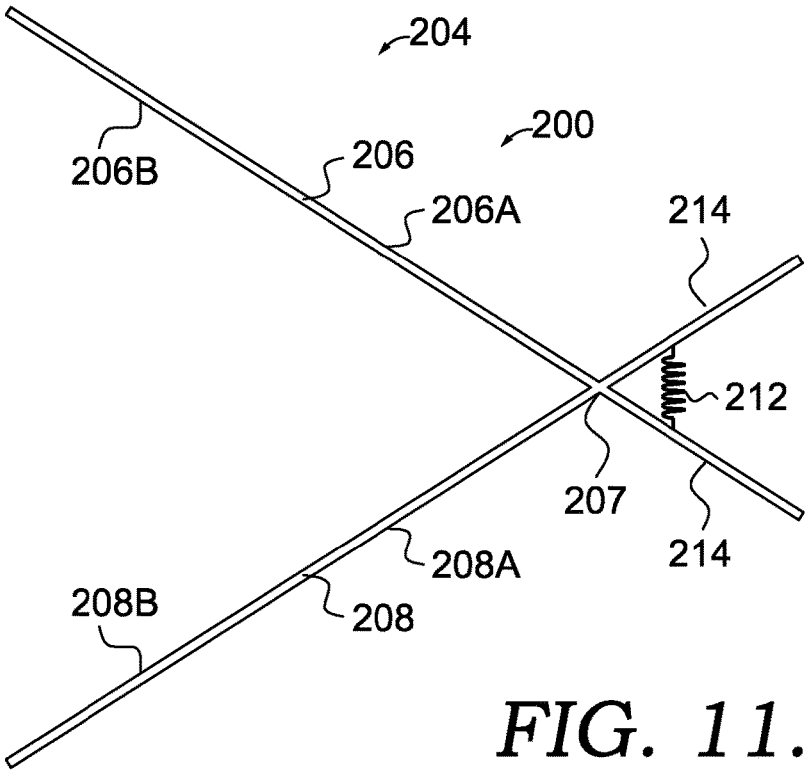
FIG. 11 illustrates a top view of the exemplary two-paneled greeting card in the open configuration, in accordance with aspects herein.
Figure 12:
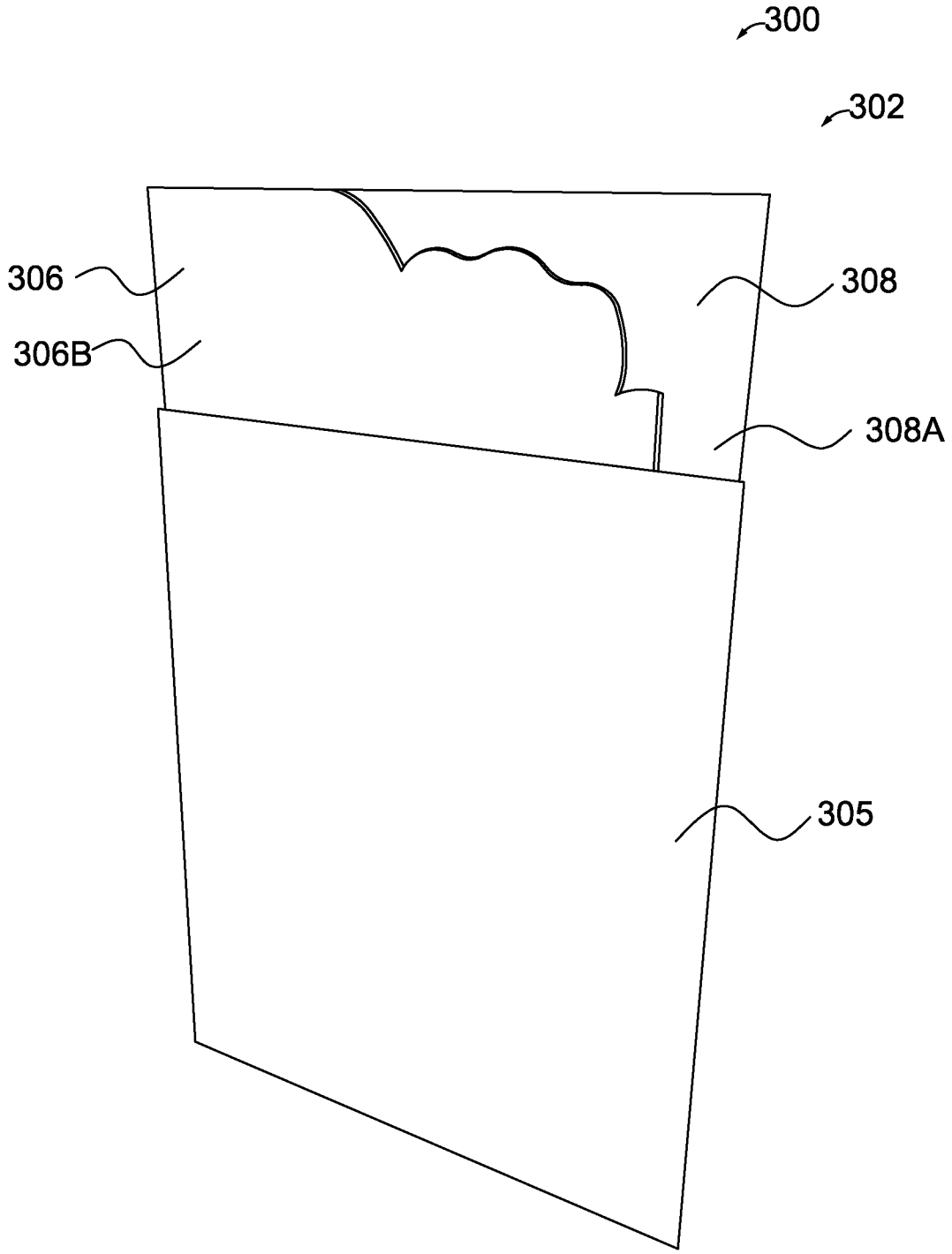
FIG. 12 illustrates a perspective view of an exemplary single-paneled greeting card in the closed configuration, in accordance with aspects herein.
Figure 13:
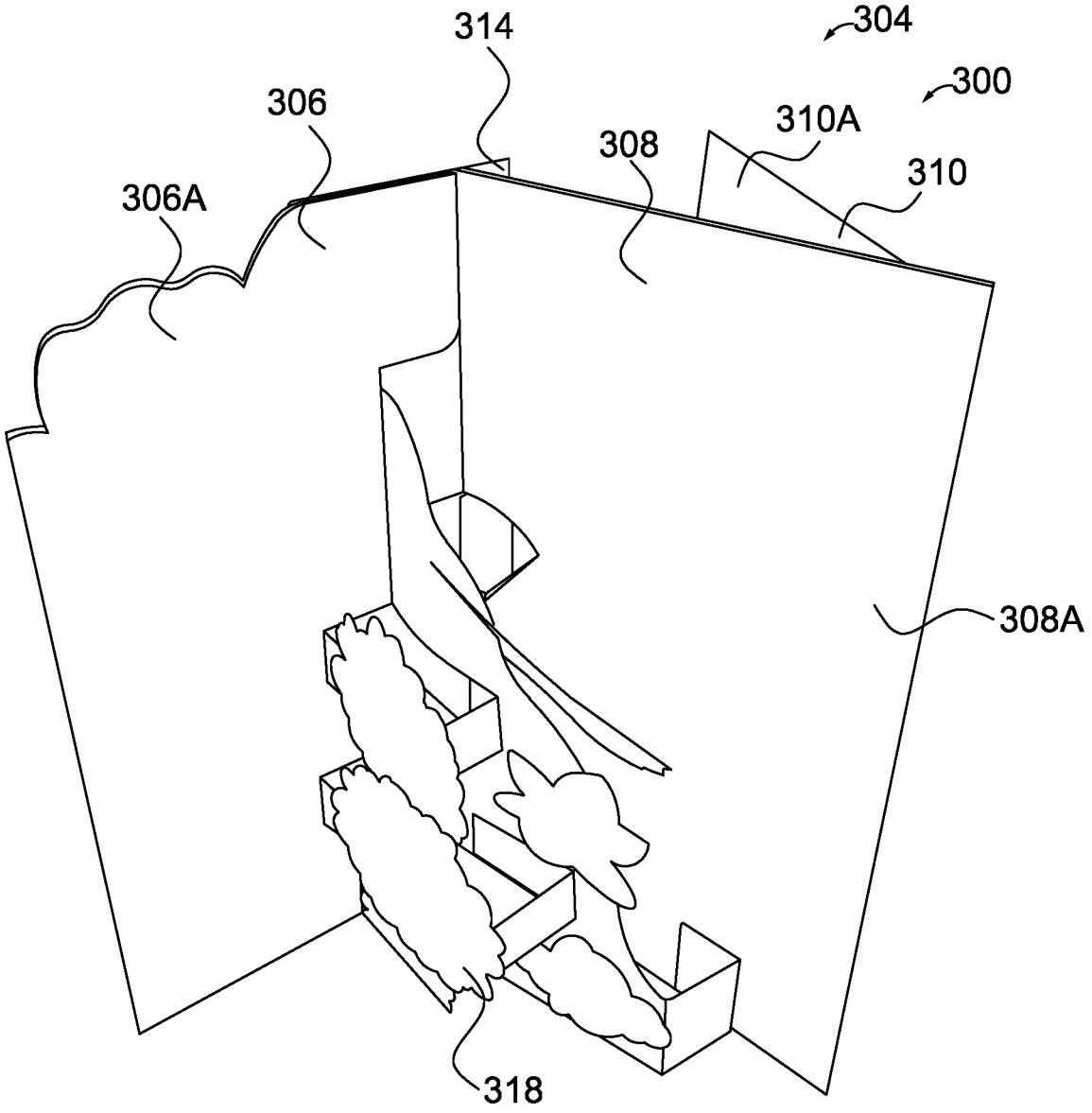
FIG. 13 illustrates a perspective view of the exemplary single-paneled greeting card in the open configuration, in accordance with aspects herein.
Figure 14:
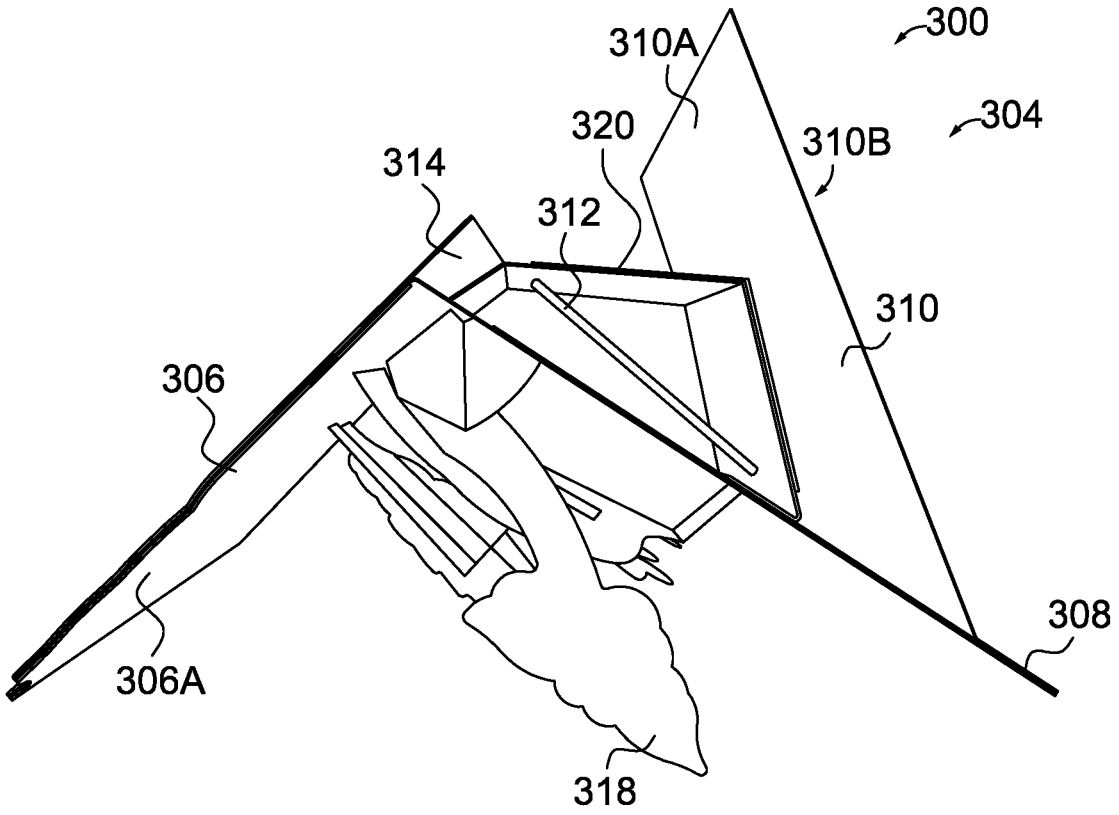
FIG. 14 illustrates a top view of the exemplary single-paneled greeting card in the open configuration, in accordance with aspects herein.

At a high level, aspects herein are generally directed to a greeting card having an open configuration and a closed configuration, and having panels which are connected through a biasing member. The greeting card may be a three-panel embodiment, as depicted in FIGS. 1-8, a two-panel embodiment, as depicted in FIGS. 9-11, or a single-panel embodiment, as depicted in FIGS. 12-14. Depending on the number of panels, the biasing member stores a force (either compressive or tensional) when the greeting card is in the closed configuration, such that the greeting card returns to the open configuration when not restrained by a removable sleeve.

Figure 1:
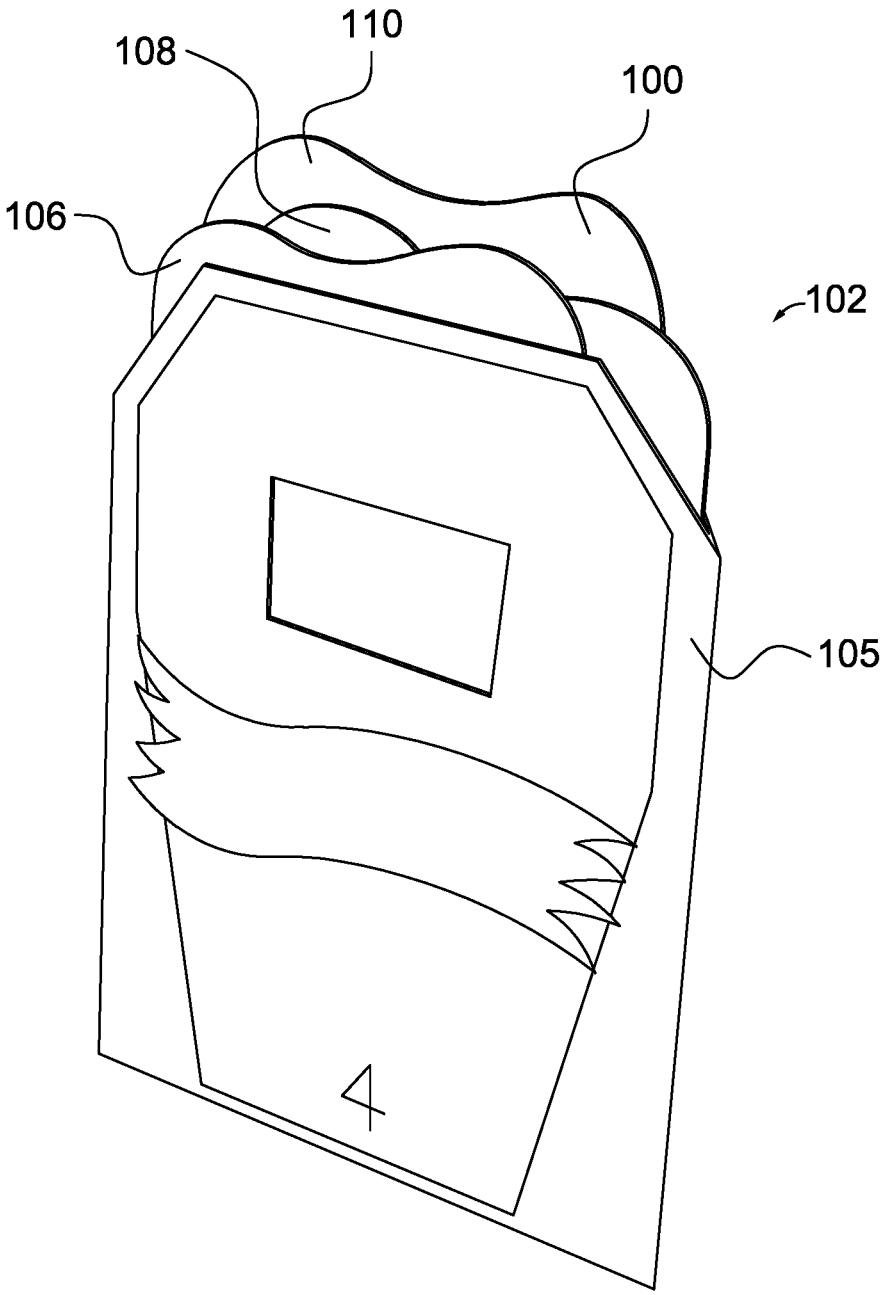
FIG. 1 illustrates an exemplary three-paneled greeting card in the closed configuration and placed within a removable sleeve, in accordance with aspects herein.
Figure 2:
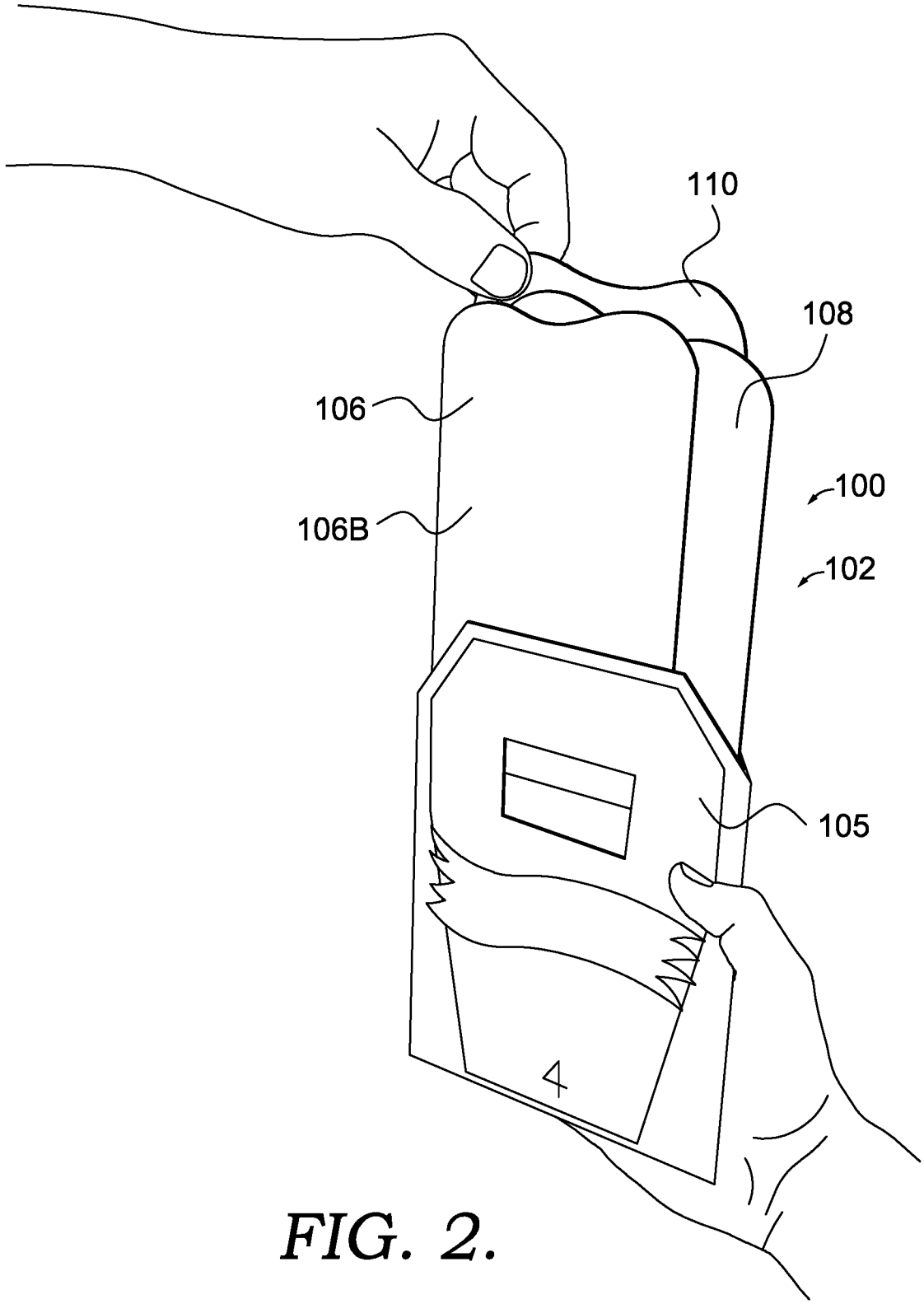
FIG. 2 illustrates the exemplary three-paneled greeting card in the closed configuration and being removed from the removable sleeve, in accordance with aspects herein.
Figure 3:
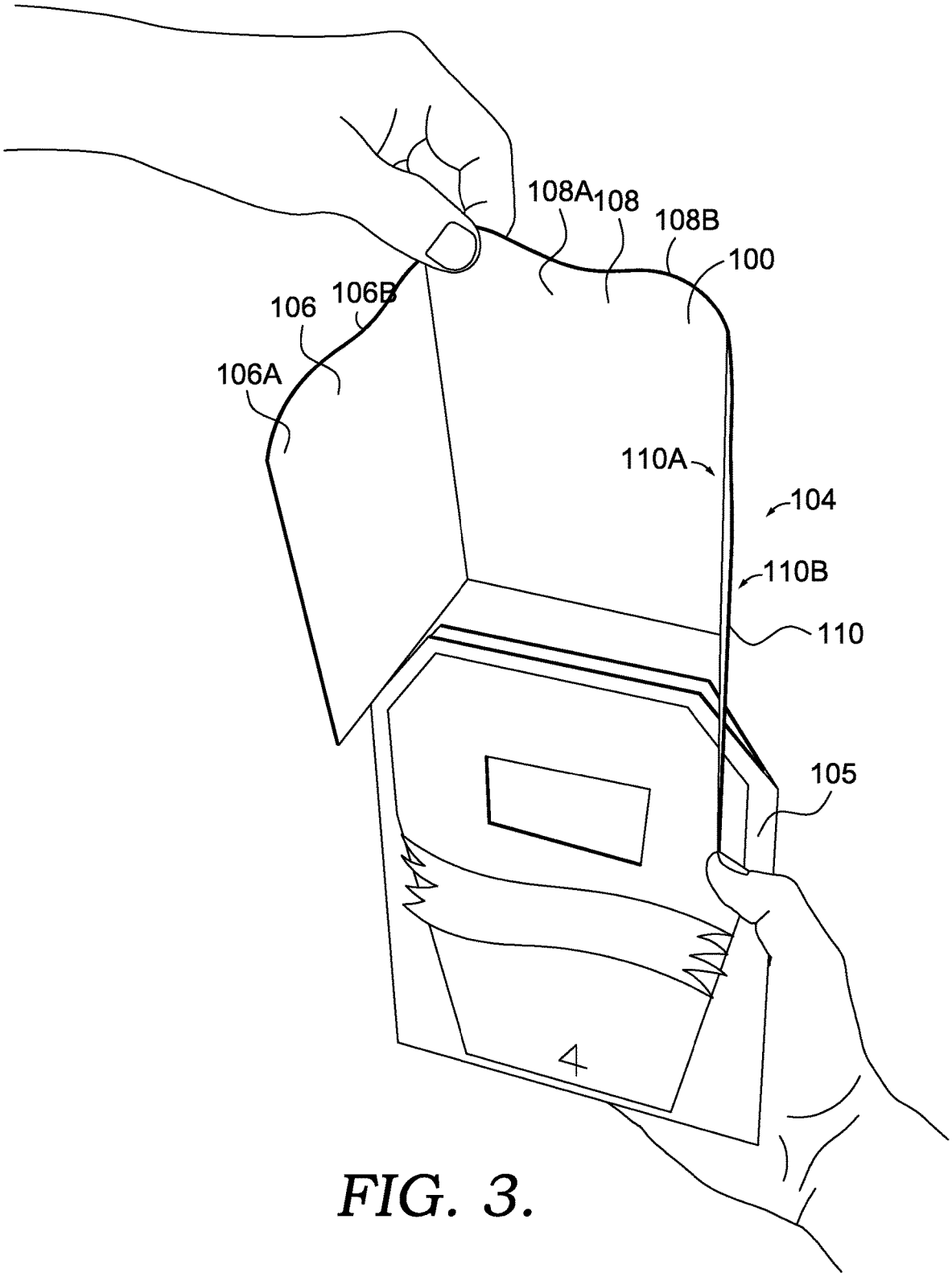
FIG. 3 illustrates the exemplary three-paneled greeting card after being removed from the removable sleeve and in the open configuration, in accordance with aspects herein.

Turning now to FIGS. 1 and 2, an exemplary three-panel greeting card 100 in the closed configuration 102 and placed within a removable sleeve 105 is illustrated. In general, FIG. 1 illustrates the exemplary three-panel greeting card 100 when it has been fully inserted within the removable sleeve 105, while FIG. 2 illustrates the exemplary greeting card being removed from the removable sleeve. Although, in FIG. 2, the exemplary greeting card 100 has not been completely removed from the removable sleeve 105, and thus, the removable sleeve 105 maintains the greeting card in the closed configuration 102. In general, the closed configuration 102 refers to a state in which panels (reference numerals 106, 108 and 110 as shown in FIG. 3) of the three-panel greeting card 100 are folded, such that surfaces of the panels lay in a parallel, or close to parallel configuration. In accordance with aspects herein, the surfaces of the panels are denoted by reference numerals 106A and 106B for the front surface and back surface of the left panel 106, 108A and 108B for the front surface and back surface of the center panel 108, and 110A and 110B for the front surface and back surface of the right panel 110, as best depicted in FIG. 3. In other words, the closed configuration generally refers to when the surfaces (106A, 106B, 108A, 108B, 110A, 110B) of at least two of the panels are in contact with one another.

Figure 4:
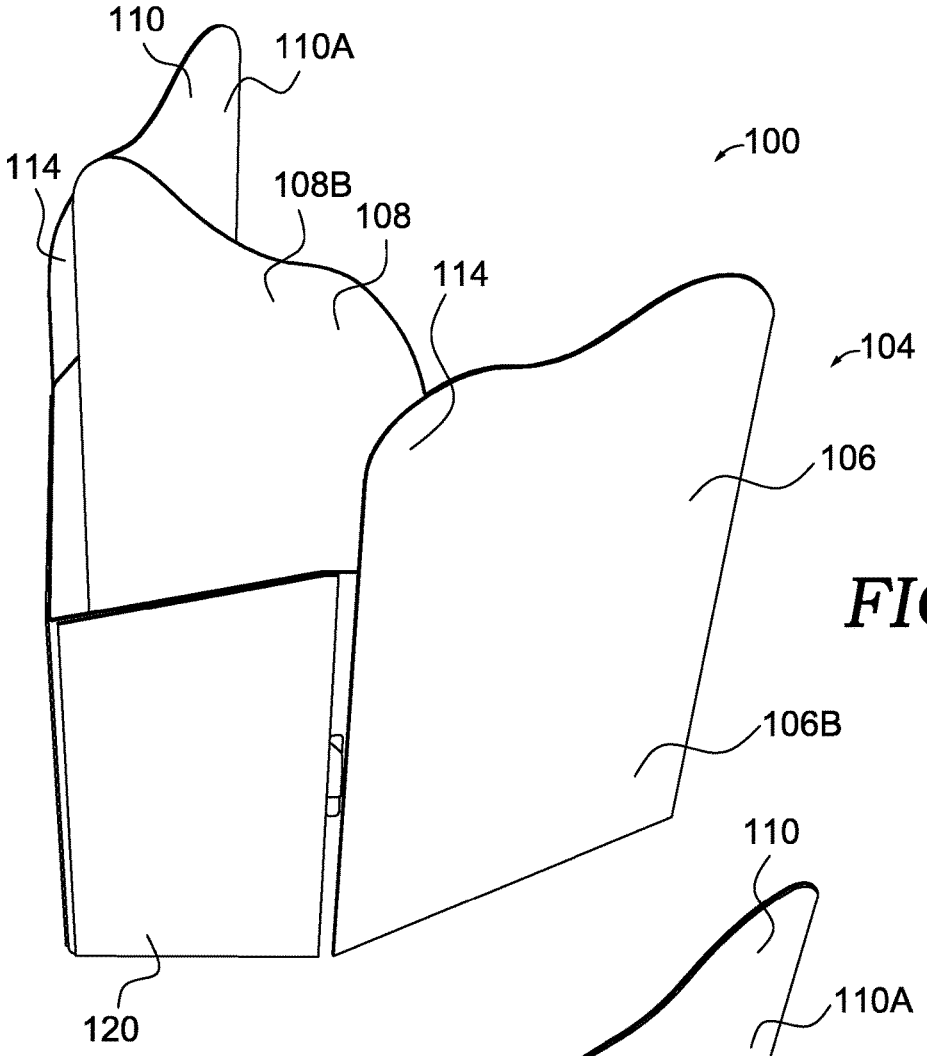
FIG. 4 illustrates a perspective view of the exemplary three-paneled greeting card in the open configuration, in accordance with aspects herein.
Figure 5:
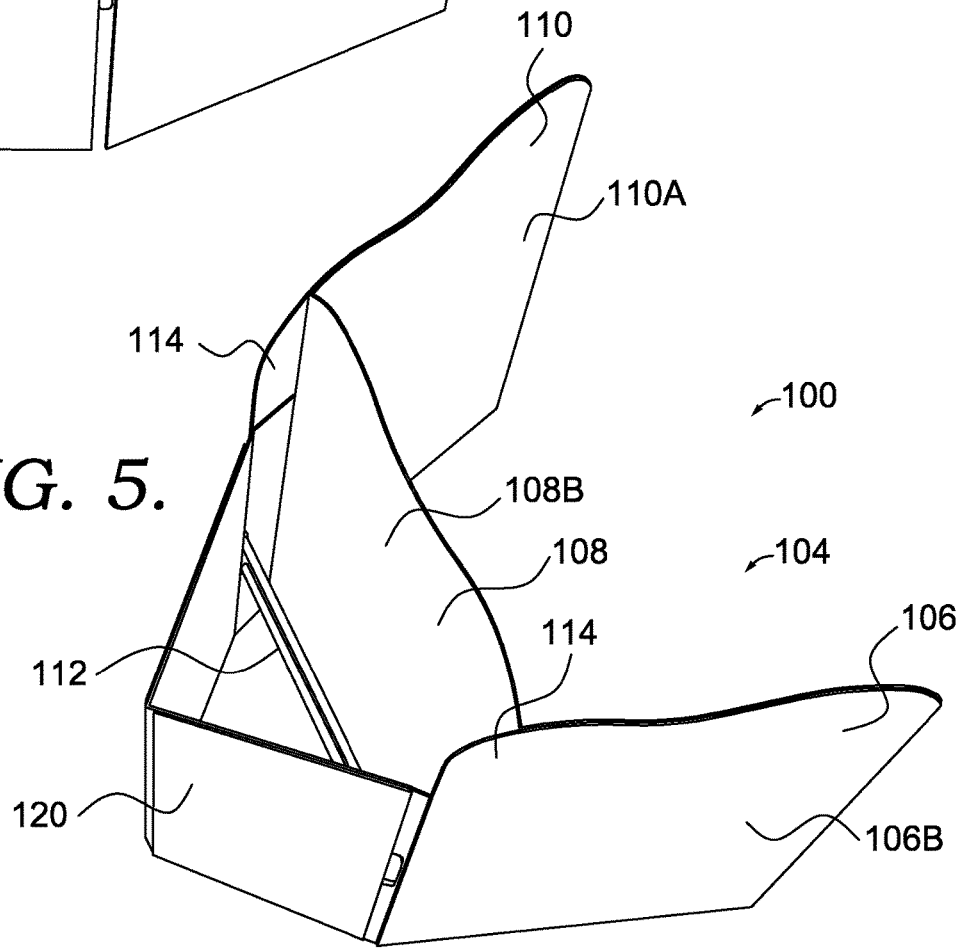
FIG. 5 illustrates a perspective view of the exemplary three-paneled greeting card in the open configuration, in accordance with aspects herein.

Turning now to FIGS. 4 and 5, the mechanism by which the greeting card 100 opens will be discussed. As best depicted in FIG. 5, a biasing member 112 coupling a portion of the left panel 106 to a portion of the right panel 110 is depicted. In accordance with aspects herein, a portion the left panel 106 and a portion of the right panel 110 extend behind the center panel 108. In other words, the portion of the left panel 106 and the portion of the right panel 110 positioned proximate the back surface 108B of the center panel 108 when the card is in the open configuration act as levers for the biasing member 112 to apply the tensional force on the left and right panels to move them and, in turn, the three-panel greeting card 100 from the closed configuration 102 to the open configuration 104. The biasing member 112 is generally coupled to the left panel 106 and right panel 110 at a lever edge 114. The biasing member 112 may be coupled to the lever edge 114 of the left panel 106 and right panel 110 by bonding or an adhesive. In accordance with aspects herein, the lever edge 114 may alternatively be referred to as an "effort arm", while the left panel 106 and right panel 110 may alternatively be referred to as a "load arm". In other words, the "effort arm" generally refers to any portion of the greeting card 100 to which the biasing member 112 is applying a force, while the "load arm" generally refers to the portion of the greeting card 100 which is being moved by the "effort arm". Alternatively, the biasing member may be coupled to the lever edge 114 of the left panel 106 and to the right panel 110 by mechanical coupling. The biasing member is coupled to the left panel 106 and right panel 110 at a point generally extending behind the center panel 108. The biasing member may be coupled directly to the edges of the left panel 106 and the right panel 110, or the biasing member may be coupled at a location offset from the edges of the left panel 106 and the right panel 110.

With continued reference to FIG. 5, when the left panel 106 and the right panel 110 are moved to the closed configuration 102, the biasing member holds a tensional force. This tensional force, when applied to left panel 106 and the right panel 110, is operable to move the three-panel greeting card 100 from the closed configuration 102 to the open configuration 104. Accordingly, the biasing member 112 may be described an elastically resilient member, such as a rubber band. However, other types of biasing members, such as a spring, are considered to be within the scope of this disclosure.

Turning now to FIG. 3, the exemplary three-panel greeting card 100 has been removed from the removable sleeve 105, such that the greeting card has moved from the closed configuration 102 (as depicted in FIGS. 1 and 2), to the open configuration 104. In other words, removing the greeting card 100 from the removable sleeve 105 permits the biasing member to move the greeting card from the closed configuration 102 to the open configuration 104. In general, the open configuration 104 references to a configuration in which the surfaces of the panels (reference numeral 106, 108 and 110) are not parallel with respect to one another. In other words, in the open configuration 104, the surfaces of the panels are not in contact with one another.

Figure 6:
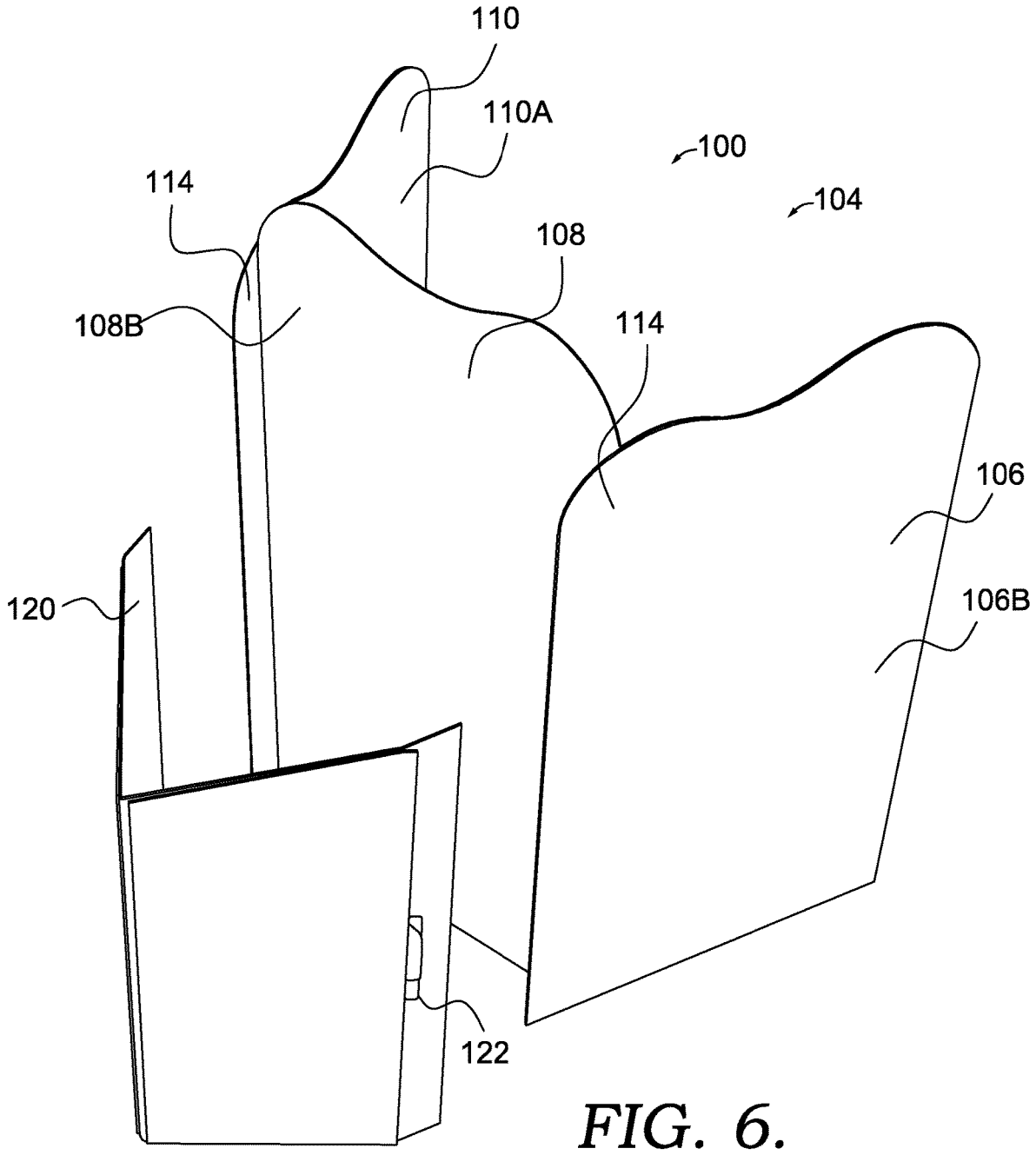
FIG. 6 illustrates a perspective view of the exemplary three-paneled greeting card in the open configuration, in accordance with aspects herein.

Turning now to FIG. 6, the exemplary three-panel greeting card 100 is depicted as having a concealing component 120. The concealing component 120 generally serves to hide the biasing member from view of the receiver of the exemplary three-panel greeting card 100. In accordance with aspects herein, the concealing component 120 is coupled to the lever edge 114 through adhesive or bonding. Additionally, the concealing component may have apertures 122 which the biasing member 112 may be inserted into, for easier coupling to the lever edges 114. In other words, the concealing component provides attachment means for the lever edges 114, and conceals the biasing member 112.

Figure 7:
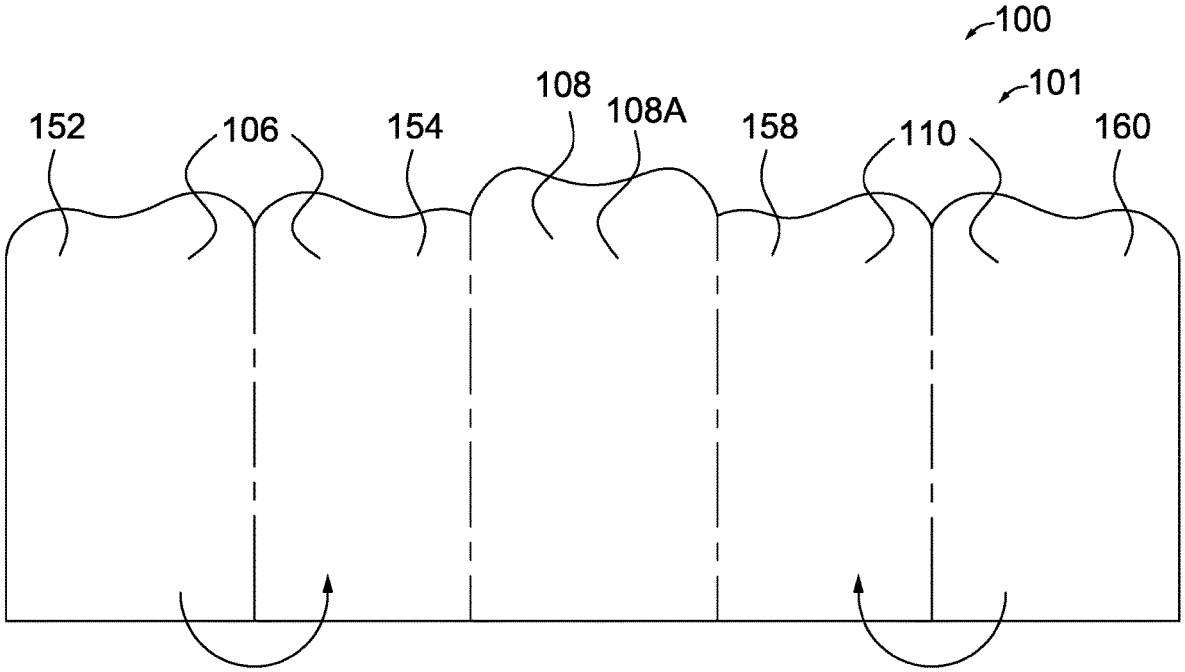
FIG. 7 illustrates a back view of a card blank used to create the exemplary three-paneled greeting card, in accordance with aspects herein.

Turning now to FIG. 7, a card blank 101 is depicted, which may be converted into the three-panel exemplary greeting card 100. As depicted in FIG. 7, outer most panels 152 and 160 are wider than two adjacent panels 154 and 158, such that when the outer most panels 152 and 160 folded over on the adjacent panels 154 and 158, a lever edge 114 is formed (as depicted in FIG. 8). The card blank 101 may be formed from many methods, such as die cutting, however other methods of forming a card blank are considered to be within the scope of this disclosure. As depicted in FIG. 7, panels 152 and 160 are folded onto panels 154 and 158, respectively, forming the left panel 106 and the right panel 110, respectively. The arrows on FIG. 7 depict the manner in which panels 152 and 160 are folded onto panels 154 and 158 to form the left panel 106 and the right panel 110, respectively. After folding along the arrows shown in FIG. 7, FIG. 8 depicts the card blank 101 after panels 152 and 160 have been folded onto panels 154 and 158, respectively. As seen in FIG. 8, the lever edges 114 are represented by the areas between the hidden lines (representing the edges of the center panel 108) and the solid lines of the left panel 106 and right panel 110.

Turning now to FIG. 9, an exemplary two-panel greeting card 200 is depicted in a closed configuration 202. The exemplary two-panel greeting card 200 is depicted as having a first panel 206 and a second panel 208, and being placed within a removable sleeve 205. FIGS. 10 and 11 depict that the first panel 206 and the second panel 208 are movable about a first pivot point 207 having a first axis. The first panel 206 may have a front surface 206A and a rear surface 206B, while the second panel 208 may similarly have a front surface 208A and a rear surface 208B. The first pivot point 207 may be a fold, crease, or other type of connection which allows for rotation of the first panel 206 and the second panel 208 with respect to one another. As additionally seen in FIG. 10, the biasing member 212 used with respect to the two-panel greeting card 200 holds a compressive force when in the closed configuration 202. As discussed previously with respect to the removable sleeve 105 in FIGS. 1-8, the removable sleeve 205 serves to hold the two-panel greeting card 200 in the closed configuration. Then, when the two-panel greeting card 200 is removed from the removable sleeve 205, the compressive force stored in the biasing member 212 serves to convert the two-panel greeting card 200 from the closed configuration 202 to the open configuration 204, which is depicted in FIG. 11. Additionally, as seen in FIGS. 10 and 11, the biasing member 212 is depicted as a spring, although other biasing members which can be used to store a compressive force are considered to be within the scope of this disclosure.

Turning now to FIG. 10, a top view of the exemplary two-panel greeting card 200 is depicted. As discussed with respect to FIG. 9, when the two-panel greeting card 200 is in the closed configuration 202, the biasing member 212 holds a compressive force. However, when the two-panel greeting card 200 is placed into the removable sleeve 205, the greeting card is maintained in the closed configuration 202.

FIG. 11 represents the two-panel greeting card 200 after being removed from the removable sleeve 205. In order to move the two-panel greeting card 200 from the closed configuration 202 to the open configuration 204, the biasing member 212 applies a force to the lever arms 214. In accordance with aspects herein, the biasing member 212 may be coupled to the lever arms 214 by bonding, adhesives, or mechanical coupling.

Turning now to FIG. 12, an exemplary single-panel greeting card 300 is depicted in a closed configuration 302. As seen in FIG. 12, the single-panel greeting card 300 is depicted as having a first portion 306 and a second portion 308, which are held in the closed configuration 302 by use of a removable sleeve 305. The first portion 306 may have a front surface 306A and a rear surface 306B, the second portion 308 may have a front surface 308A and a rear surface 308B, and the third portion 310 may have a front surface 310A and a rear surface 310B. In FIG. 12, the back surface 306B of the first portion 306 and the front surface 308A of the second portion 308 are visible. Similarly to the exemplary greeting cards 100 and 200, the single-panel greeting card 300 utilizes a biasing member 312 (depicted in FIG. 14) to open the greeting card 300. Additionally, the biasing member 312 of the greeting card 300 is coupled to a lever edge 314, such that the biasing member 312 holds a tensional force (similarly to the three-panel greeting card 100). Accordingly, when the greeting card 300 is removed from the removable sleeve 305, the single-panel greeting card is moved from the closed configuration 302 to the open configuration 304, which is depicted in FIG. 13. Also shown in FIG. 13, the single-panel greeting card 300 may further comprise a third portion 310, which may be used to prevent the single-panel greeting card 300 from falling over when placed on a surface.

Turning now to FIG. 14, a top view of the exemplary single-panel greeting card 300 is depicted. As discussed previously, the biasing member 312 holds a tensional force when the greeting card is in the closed configuration 302. Accordingly, when the greeting card 300 is removed from the removable sleeve 305, the biasing member 312 applies a force to the lever edge 314, such that the greeting card moves from the closed configuration 302 to the open configuration 304. Further, the single-panel greeting card 300 may further comprise pop-art 318, of which the motion of the single-panel greeting 300 moving from the closed configuration 302 to the open configuration 304 causes the pop-art 318 to stand off the inner surface of the first portion 306 and the second portion 308. In accordance with further aspects herein, the greeting card 300 may further comprise a concealing structure 320, which assists in the coupling of the biasing member 312 to the lever edge 314.

Figure 15:
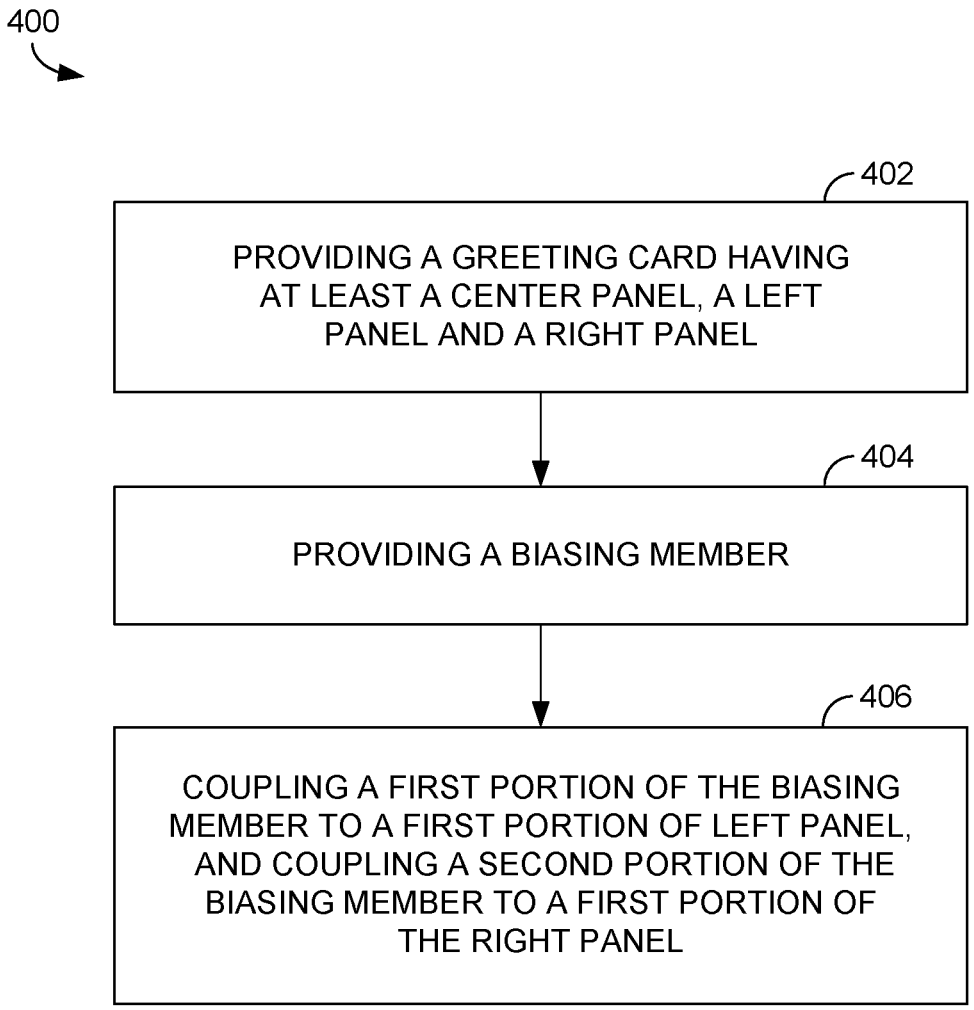
FIG. 15 illustrates an exemplary method of manufacturing a greeting card, in accordance with aspects herein.

Turning now to FIG. 15, an exemplary method of manufacturing a greeting card 400 is depicted. In accordance with aspects herein, Block 402 depicts providing a greeting card having at least a center panel, a left panel and a right panel. Next, block 404 depicts providing a biasing member. Further, block 406 depicts coupling a first portion of the biasing member to a first portion of left panel, and coupling a second portion of the biasing member to a first portion of the right panel. Although not shown in FIG. 15, block 406 may further comprise wherein when the greeting card is in the open configuration, the portion of the left panel and the portion of the right panel are positioned proximate a back surface of the center panel.

The method of manufacturing discussed herein may include additional steps not shown in FIG. 15. For example, the method of manufacturing 400 may further include positioning the greeting card in the closed configuration and then placing the greeting card in the closed configuration in a removable sleeve. Additionally, the method of coupling the first portion of the biasing member to the first portion of the left panel and coupling the second portion of the biasing member to the second portion of the right panel may utilize a bonding agent, an adhesive, or mechanical coupling. As discussed herein, the biasing member generally carries a tensional force that is greater when the greeting card is in the closed configuration than when the greeting card is in the open configuration. Further, the method of manufacturing represented by FIG. 15 may further comprise forming an aperture in each of the first portion of the right panel and the first portion of the left panel, and coupling the biasing member to the aperture in each of the first portion of the right panel and the first portion of the left panel.

The present invention has been described in relation to particular embodiments, which are intended in all respects to be illustrative rather than restrictive. Alternative embodiments will become apparent to those of ordinary skill in the art to which the present invention pertains without departing from its scope.

Various embodiments of the invention have been described to be illustrative rather than restrictive. Alternative embodiments will become apparent from time to time without departing from the scope of embodiments of the inventions. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. A greeting card having an open configuration and a closed configuration, the greeting card comprising:

a center panel having a front surface and a back surface;

a left panel having a front surface and a back surface, wherein the left panel is coupled to the center panel at a left pivot point;

a right panel having a front surface and a back surface, wherein the right panel is coupled to the center panel at a right pivot point;

a biasing member coupled to a portion of the left panel and coupled to a portion of the right panel;

a concealing component coupled to a portion of the left panel and coupled to a portion of the right panel, wherein the concealing component at least partially conceals the biasing member, wherein the biasing member is coupled to opposite sides of the concealing component, wherein one side of the concealing component is coupled to a portion of the left panel by bonding or an adhesive, wherein another side of the concealing component is coupled to a portion of the right panel by bonding or an adhesive, and wherein the biasing member is coupled to the portion of the left panel and the portion of the right panel via the concealing component;

wherein when the greeting card is in the open configuration, the portion of the left panel and the portion of the right panel are parallel to the center panel;

wherein when the greeting card is in the closed configuration, the biasing member contains a tensional force greater than when the greeting card is in the open configuration; and wherein the tensional force is operable to move the greeting card from the closed configuration to the open configuration.

2. The greeting card of claim 1, wherein the portion of the left panel and the portion of the right panel act as levers for the biasing member to apply the tensional force on the left and right panels to move them and, in turn, the greeting card from the closed configuration to the open configuration.

3. The greeting card of claim 2, wherein the biasing member is an elastically resilient member.

4. The greeting card of claim 3, wherein the elastically resilient member is a rubber band.

5. The greeting card of claim 1 further comprising a removable sleeve, wherein when the greeting card is placed in the removable sleeve when in the closed configuration and wherein the removable sleeve maintains the greeting card in the closed configuration.

6. The greeting card of claim 5, wherein removing the greeting card from the removable sleeve permits the biasing member to move the greeting card from the closed configuration to the open configuration.

7. The greeting card of claim 1, wherein the biasing member is coupled to the portion of the left panel and the portion of the right panel by mechanical coupling.

8. A greeting card having an open configuration and a closed configuration, comprising:

first and second panels coupled together, wherein the first panel is movable with respect to the second panel about a first pivot point having a first axis, wherein the first axis is generally within a plane of the first panel, wherein the first panel has an effort arm portion on one side of the first pivot point and a load arm portion on a side of the first pivot point opposite the effort arm portion;

a biasing member coupled with the effort arm portion of the first panel and operable to move the first panel about the first pivot point; and a concealing component coupled to a portion of the first panel and a portion of the second panel, wherein the concealing component at least partially conceals the biasing member, wherein the first panel pivots about an edge of the second panel, and wherein the biasing member is coupled with the effort arm portion of the first panel via the concealing component.

9. The greeting card of claim 8, further comprising a third panel positioned intermediate to the first panel and the second panel, wherein the third panel has a first edge adjacent the first panel and wherein the first edge of the third panel is the first pivot point.

10. The greeting card of claim 9, wherein the second panel is movable with respect to the first panel about a second pivot point having a second axis, wherein the second axis is generally within a plane of the second panel, wherein the second panel has an effort arm portion on one side of the second pivot point and a load arm portion on a side of the second pivot point opposite the effort arm portion, wherein the third panel has a second edge adjacent the second panel, wherein the second edge of the third panel is the second pivot point, and wherein when the greeting card is in the closed configuration, the biasing member contains a tensional force greater than when the greeting card is in the open configuration.

11. A method of manufacturing a greeting card having an open configuration and a closed configuration, the method comprising:

providing a greeting card having at least a center panel, a left panel and a right panel;

providing a biasing member;

coupling a first portion of the biasing member to a first portion of the left panel, and coupling a second portion of the biasing member to a first portion of the right panel;

coupling a concealing component to a portion of the first panel and a portion of the second panel via a bonding agent or an adhesive, wherein the concealing component at least partially conceals the biasing member, wherein the concealing component is positioned intermediate the first portion of the left panel and the second portion of the right panel, and wherein the concealing component is utilized in the coupling of the first portion of the biasing member to the first portion of the left panel and in coupling the second portion of the biasing member to the second portion of the right panel; and wherein when the greeting card is in the open configuration, the portion of the left panel and the portion of the right panel are positioned proximate a back surface of the center panel.

12. The method of claim 11, further comprising:

positioning the greeting card in the closed configuration; and placing the greeting card in the closed configuration in a removable sleeve.

13. The method of claim 11, wherein the method of coupling the first portion of the biasing member to the first portion of the left panel and coupling the second portion of the biasing member to the second portion of the right panel is a mechanical coupling.

14. The method of manufacturing of claim 11, wherein the biasing member carries a tensional force that is greater when the greeting card is in the closed configuration than when the greeting card is in the open configuration.

15. The method of manufacturing of claim 11, further comprising:

forming an aperture in each of the first portion of the right panel and the first portion of the left panel; and coupling the biasing member to the aperture in each of the first portion of the right panel and the first portion of the left panel.

16. The greeting card of claim 1, wherein the first pivot point and the second pivot point are a fold or a crease.

17. A method of manufacturing a greeting card having an open configuration and a closed configuration, the method comprising:

providing a greeting card having at least a center panel, a left panel and a right panel;

providing a biasing member;

coupling a first portion of the biasing member to a first portion of the left panel, and coupling a second portion of the biasing member to a first portion of the right panel;

coupling a concealing component to a portion of the first panel and a portion of the second panel, wherein the concealing component at least partially conceals the biasing member;

wherein when the greeting card is in the open configuration, the portion of the left panel and the portion of the right panel are positioned proximate a back surface of the center panel;

forming an aperture in each of the first portion of the right panel and the first portion of the left panel; and coupling the biasing member to the aperture in each of the first portion of the right panel and the first portion of the left panel.

* * * * *